United States Patent [19]

Eckebring et al.

[11] Patent Number: 4,805,521

[45] Date of Patent: Feb. 21, 1989

[54] SUPPLY AIR DEVICE

[75] Inventors: Bengt O. D. Eckebring; Sven C. Wallin, both of Enköping, Sweden

[73] Assignee: AB Bahco Ventilation, Enköping, Sweden

[21] Appl. No.: 141,527

[22] Filed: Jan. 7, 1988

[30] Foreign Application Priority Data

Jan. 28, 1987 [SE] Sweden ..... 8700327

[51] Int. Cl.[4] ..... F24F 13/06

[52] U.S. Cl. ..... 98/40.01; 55/410; 55/473; 98/40.1; 98/108; 98/114

[58] Field of Search ..... 55/410, 473; 98/40.01, 98/40.05, 40.1, 40.11, 101, 108, 114

[56] References Cited

U.S. PATENT DOCUMENTS

| | | | |
|---|---|---|---|
| 2,651,250 | 9/1953 | Marquardt | 98/40.11 X |
| 2,781,715 | 2/1957 | Labus | 98/40.05 |
| 4,170,930 | 10/1979 | Lind | 98/40.11 |
| 4,616,558 | 10/1986 | Ball et al. | 98/40.1 X |

FOREIGN PATENT DOCUMENTS

| | | | |
|---|---|---|---|
| 2013244 | 8/1978 | Fed. Rep. of Germany | 98/40.1 |
| 2155170 | 9/1985 | United Kingdom | 98/40.11 |

*Primary Examiner*—Harold Joyce

[57] ABSTRACT

A supply air device for spreading an air flow from a generally flat, perforated external element (21,22,23) comprising a box-like casing (10) serving as an air distribution chamber and having means for connection to a supply air duct, and at least one primary side-spreading device (18,26) located in the distribution chamber and being adapted to bring about a forwardly directed, transversally diverging air flow towards and through perforated external element. Side guiding plates (24,25) are provided in the distribution chamber so as to extend between the primary side-spreading device (26) and side edge portions (22,23) of perforated external element, guiding plates being bent into a convexly curved configuration, as seen from the front of the device, whereby the air flow (P1,P2,P3) is caused to additionally diverge transversally, especially to about 180°.

13 Claims, 2 Drawing Sheets

SUPPLY AIR DEVICE

Figure 1:
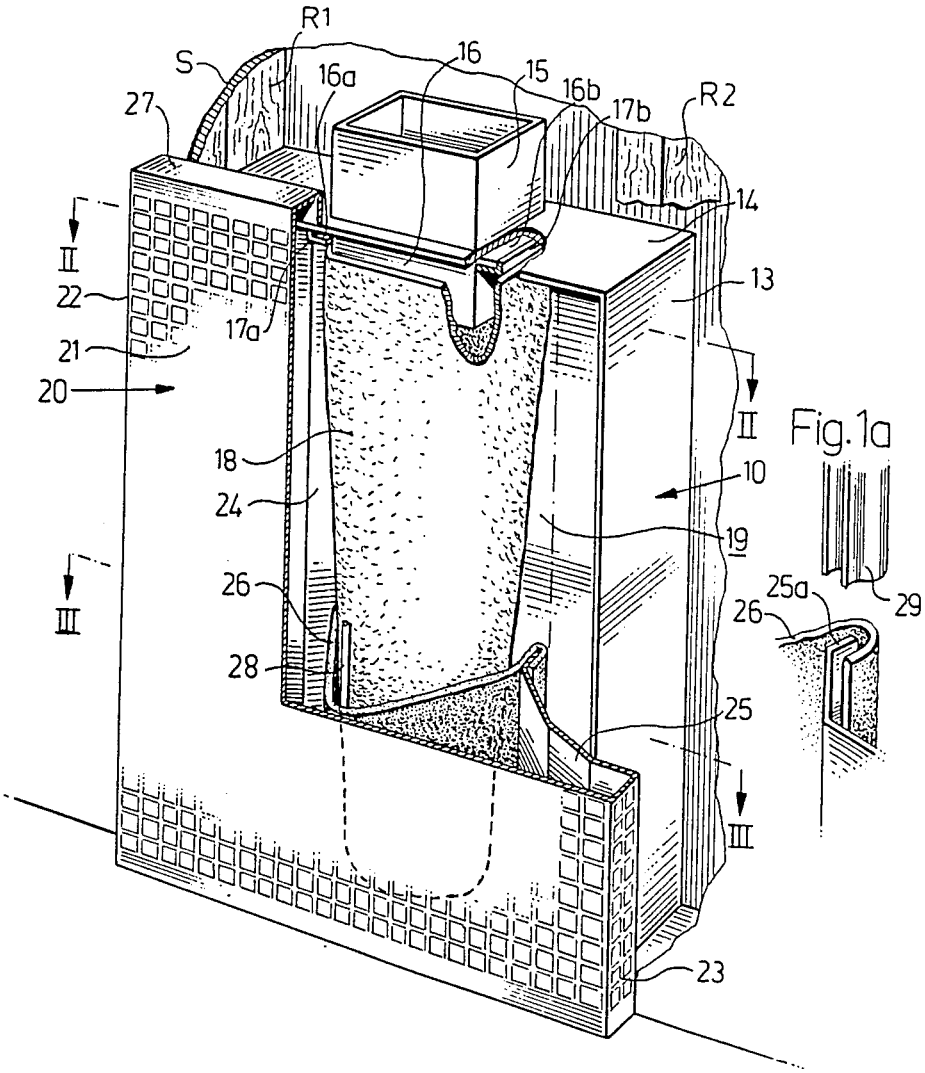

The invention relates to a supply air device for spreading an air flow from a generally flat, perforated external element, comprising a box-like casing serving as an air distribution chamber and having means for connection to a supply air duct, and at least one primary side-spreading device located in the distribution chamber and being adapted to bring about a forwardly directed, transversally diverging air flow towards and through said perforated external element.

Such a supply air device is known from SE-B-No. 8306695-1, wherein the primary side-spreading device comprises a perforated and thus air-permeable wall being convexly curved forwardly towards the essentially flat, perforated external element. This curved wall is internally and externally connected to a flat rear wall of the casing, whereby a rather good side-spreading of the supply air is achieved. According to this document, the divergent character of the flow pattern will hereby be essentially retained or be only slightly modified. However, it appears impossible to avoid that a considerable turbulence occurs adjacent to the side walls of the box-like casing, particularly in the region of the interior corner portions of the casing.

The object of the present invention is to improve the known supply air device in such a way that the air flow through the perforated external element is caused to additionally diverge transversally, especially to about 180°, while considerably reducing the turbulence. It should be possible to mount the device either freely or into a wall, especially with a variable depth. The device should also be easy to manufacture, to install and to maintain.

These objects are achieved by the features defined in the claims, giving the following effects and advantages:

EFFECT/ADVANTAGE

The side guiding plates secure a smooth flow, substantially without turbulence, from the side-spreading device to the region of the side edge portions of the perforated external element, thereby preventing a flow towards the internal edge portion of the casing and the associated turbulence. The air-flow follows along the curved side guiding plates (Coanda-effect) and is consequently caused to diverge additionally.

A convexly curved, air-permeable wall brings about a uniformly diverging air-flow. Since the side guiding plates extend from the side edge portions of the air-permeable wall the flow pattern is especially favourable, since there is no considerable change of direction in this region.

The transverse side element portions of the perforated external element facilitate a transverse air-flow, i.e. substantially in parallel to the planar front element portion.

The relatively small depth of the side element portions of the perforated external element constitute a special advantage when the device is mounted into a wall, since it makes the protruding depth of the element rather small, in spite of a good side-spreading.

The end portion of the side guiding plates, which is parallel to the front element portion, secures, by way of the Coanda-effect, a straight transverse air-flow (additionally diverging to about 180°).

The box-shaped casing and the primary side-spreading device are easy to reach for inspection, maintenance and replacement of the primary side-spreading device, possible filters etc.

Facilitates the maintenance (e.g. the replacement) of the air-permeable wall and makes it easier to reach possible internally located filters and the like.

Facilitates the manufacture, installation and replacement of the air-permeable wall.

Enables a certain variation of the flow pattern and the diverging angle.

Enables a flush mounting in walls having different thickness.

A uniform air distribution sideways as well as elevationally (upon normal installation of the device in a wall).

The transverse outflow from the device can be controlled at will.

The invention will be explained more fully below with reference to the appended drawings which illustrate a preferred embodiment serving as an example.

Figure 2:
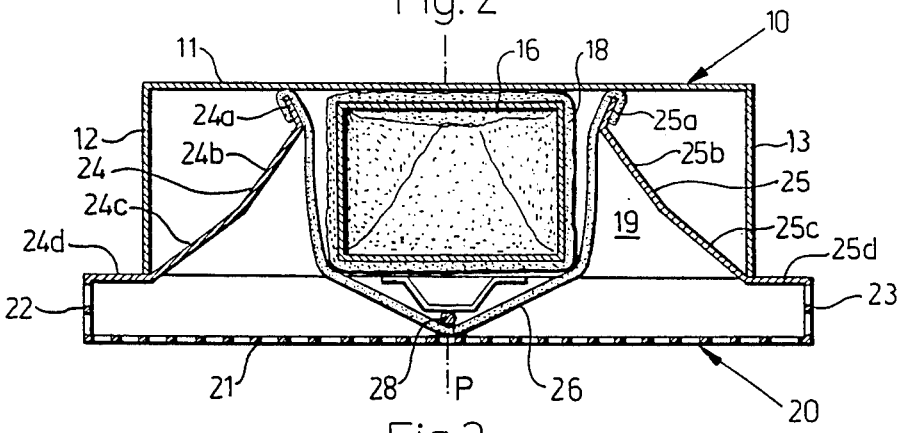
Figure 3:
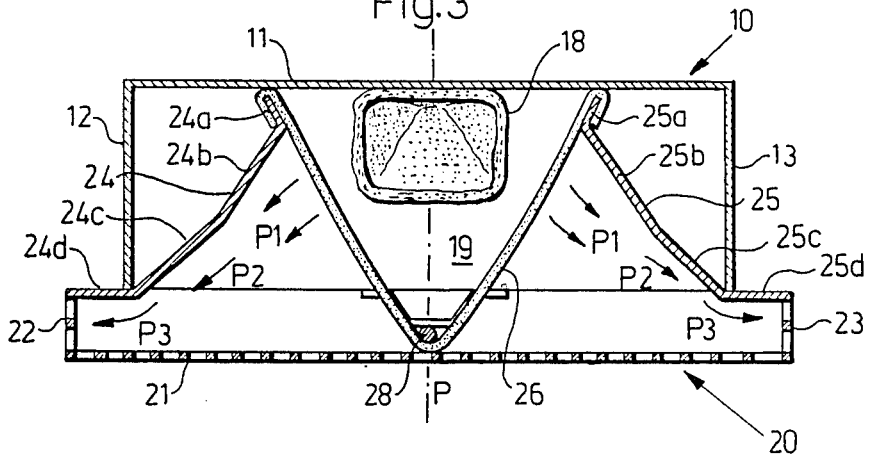
Figure 4:
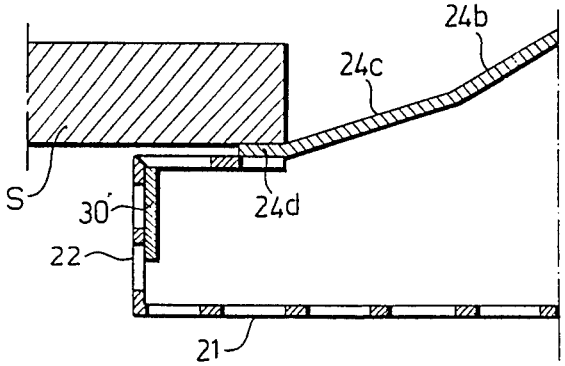

FIG. 1 shows in a perspective view (partially cut away) a supply air device according to the invention mounted into a wall;

FIG. 1*a* shows (likewise in a perspective view) a detail from FIG. 1;

FIGS. 2 and 3 show cross-sections through the supply air device along the lines II—II and III—III, respectively, of FIG. 1; and FIG. 4 shows a cross-sectional view (in a larger scale) of a portion of the air supply device at one side thereof, including a shield device for controlling the transversal outflow.

The air supply device illustrated in FIGS. 1–3 comprises essentially two mutually detachable units, i.e. a rear box-shaped casing 10 and a unit 20 being telescopically insertable therein from the front and including a perforated external element 21,22,23, two side guiding plates 24,25 and a convexly (as seen from the front) curved, air-permeable wall 26.

The box-shaped casing 10, which is made of a galvanised or in some other way surface treated plate, consists of a rear wall 11, side walls 12,13 and upper and lower walls 14 (only the upper wall 14 is visible in FIG. 1). The upper wall 14 has a rectangular opening (not shown) joining to a rectangular coupling fitting 15 to be connected to a supply air duct (not shown). At the underside of the upper wall 14, a fitting 16 having the same cross-sectional dimensions as the coupling fitting 15 is detachably arranged, i.e. slidable from the front, wherein side flanges 16*a*,16*b* engage into guide rails 17*a*,17*b* secured to the underside of the upper wall 14, as shown in FIG. 1. An air permeable bag 18 is fitted and secured onto the fitting 16, e.g. by means of an adhesive.

This bag 18 is preferably made of a filter material, such as polyster fibres, and extends vertically downwards centrally through the casing in the vicinity of the rear wall 11 thereof. The cross-section of the bag tapers longitudinally, i.e. downwards, whereby a vertically (in the longitudinal direction of the bag) uniform distribution is obtained for the supply air flowing from the supply air to the interior of the casing which forms a distribution chamber 19 (of Figs. 1 and 3).

In the illustrated example, the casing 10 is mounted in a wall, e.g. between two vertical beams, R1,R2 substantially flush with a planar wall element, such as a plaster plate S, the non-illustrated air duct being connected to the coupling fitting 15 inside the wall. The unit 20 is inserted from the front into the casing 10, so that the side portions 22,23 of the perforated external element 21 abut against the outside of the wall element (the plaster plate S).

The external unit 20 of the air supply device consists of, on the one hand, the perforated external element 21,22,23, which includes a forward planar front element portion 21 with a plurality of perforated holes in a rectangular configuration and transverse, relatively shallow side element portions 22 and 23 joining to the side edges of the front element portion and having the same kind of perforated holes and, on the other hand, the side guiding plates 24,25 and the forwardly curved, air-permeable wall 26. The side guiding plates 24,25 are vertically disposed, substantially along the whole height of the casing 10, and include a rear, bent end portion **24*a* and 25*a*, respectively, an obliquely outwardly and forwardly extending portion 24*b* and 25*b*, respectively, a likewise obliquely outwardly and forwardly (although with a greater angle relative to a transversal centre plane P through the perforated external element 21) extending portion 24*c* and 25*c*, respectively, and a front end portion 24*d* and 25*d* joining to the rear edges of the perforated side element portions 22,23 and extending substantially in parallel to the front element portion 21 of the perforated external element, although at a distance therefrom. The side guiding plates 24,25 may be unitary with the perforated external element 21 but may alternatively be made as separate plates, which are secured at the top and at the bottom by means of upper and lower end plates 27 (only the upper end plate is visible in FIG. 1**) and possibly also along the rear edges of the perforated side element portions.

The forwardly towards the perforated external element convexly curved, air-permeable wall 26 is constituted by a foamed plastic sheeting having open cells. This foamed plastic sheeting is securely stretched into a substantially V-formed cross-sectional configuration between a holding bar 28, which extends vertically between said upper and lower end plates 27 and which is centrally located at a small distance from the perforated external front element portion 21, and the rear, bend end portions **24*a*,25*a* of the side guiding plates, where the foamed plastic sheeting is secured by a fold and an adhesive (according to FIGS. 2 and 3) or by means of a clamping profile element (according to FIG. 1*a***).

In the illustrated assembled position according to Figs. 1–3, the inner bag 18 and the foamed plastic sheeting 26 serve as a primary side-spreading device, which causes the air-flow supplied through the coupling fitting 15 to be uniformly distributed vertically (through the cross-sectional area tapering downwards) as well as circumferentially, i.e. in an annular region defined by the portions **24*b* and 25*b*, respectively, of the side guiding plates. It is assumed that the casing 10 joins tightly to the side guiding plate portions 24*d*,25*d* (possibly by means of special sealings and/or a flange—not shown—extending straight inwards, i.e. in parallel to the plane P, and also serving as a guide when telescopically inserting the unit 20) or to the inside of the wall element (plaster plate S), so that all outflow of air is effected via the perforated external element 21,22,23. The bag 18 and the foamed plastic sheeting 26 have such properties that the external air flow is perpendicular to the surface irrespective of the direction of the internal air flow (at the pressure side). At the outside of the foamed plastic sheeting 26 there is obtained an outwardly sideways diverging flow pattern according to the arrows P1 (FIG. 3). By way of the Coanda-effect, the outermost parts of the air flow will follow the surface of the side guiding plates, so that the outflowing air is caused to additionally diverge as indicated by the arrows P2 and P3 (FIG. 3), a portion of the outflow being directed straight sideways through the perforated side element portions 22,23**.

If desired, the air outflow pattern can be adjusted by joining the foamed plastic sheeting 26 (in a manner not shown) at a different location on the respective side guiding plate 24,25, e.g. at the portion **24*c* (and 25*c*, respectively). Hereby, one obtains a greater air flow velocity forwardly than sideways, although a certain air flow is still directed sideways from the perforated side element portions 22,23**.

As illustrated in FIG. 4, it is possible to mount shield means, e.g. in the form of a plate strip 30, in one or both of the perforated side element portions, if it is desired to cut off the transverse outflow for one reason or another. The width of the plate strip 30 can be less or equal to the depth of the perforated side element portion.

The illustrated embodiment may be modified in many ways within the scope of the inventive concept as defined in claim 1. Thus, the device may be modified so as to be mounted externally (not flush) at a wall or completely freely. The device does not have to be vertically oriented, but may in principle be oriented at will, e.g. in a ceiling.

When mounted vertically, the coupling fitting 15 (the shape of which does not have to be rectangular) may be situated at the bottom or be replaced by other air supply means. Likewise, the bag 18 and the foamed plastic sheeting 26 may be replaced by some other primary side-spreading device, e.g. a perforated, curved wall in accordance with the above-mentioned SE-B-No. 8306695-1 or an array of guiding plates or the like. The essential feature is that this primary side-spreading device joins to side guiding plates, which may be bent (as shown) or curved sideways. The side guiding plates can alternatively be secured to the casing (in which case the foamed plastic sheeting must be fastened in some other manner).

The perforated external element may have substantially deeper side portions 22,23 (especially when being mounted externally or freely), but, on the other hand, it is also possible to completely exclude these perforated side element portions. In the latter case, it is nevertheless possible to obtain a side-spreading of about 180°, especially if one retains the arrangement with side guiding plate end portions **24*d*,25*d*** being parallel to the perforated front element. If the front element is then substantially flush with the adjoining wall surface, the outermost portions of the air outflow will follow this wall surface by the Coanda-effect. Moreover, the holes of the perforated external element may be formed as desired, e.g. circular, rhombic, elongated, etc. Finally, the substantially planar external element may be somewhat curved.

We claim:

1. A supply air device for spreading an air flow from a generally flat, perforated external element (21,22,23), comprising a box-like casing (10) serving as an air distribution chamber and having means (15) for connection to a supply air duct, and at least one primary side-spreading means (18,26) located in the distribution chamber and being adapted to bring about a forwardly directed, transversally diverging air flow towards and through said perforated external element, characterized in that side guiding plates (24,25) are provided in the distribution chamber so as to extend between said primary side-spreading means and side edge portions (22,23) of said perforated external element, said guiding plates being bent into a convexly curved configuration, as seen from the front of the device, whereby the air flow (P1,P2,P3) is caused to additionally diverge transversally, especially to about 180°.

2. A supply air device as defined in claim 1, wherein said primary side-spreading means comprises an air-permeable wall (26) being convexly curved forwardly towards the perforated external element, characterized in that said side guiding plates (24,25) extend from the side edge portions of said air-permeable wall (26).

3. A supply air device as defined in claim 1, characterized in that the perforated external element includes a substantially planar front element portion (21) and adjoining, transverse side element portions (22,23), wherein said side guiding plates (24,25) join to the rear edge of each side element portion.

4. A supply air device as defined in claim 3, characterized in that said side element portions (22,23) have relatively small depth.

5. A supply air device as defined in claim 1, characterized in that the side guiding plates (24,25) extend obliquely outwardly and forwardly towards the side element portions (22,23) and merge into an end portion (24d,25d), which is substantially parallel to the perforated external element or the planar front element portion (21) thereof.

6. A supply air device as defined in claim 1, characterized in that the perforated external element (21,22,23) and the side guiding plates (24,25) are included in a detachable unit (20).

7. A supply air device as defined in claims 2 and 6, characterized in that said detachable unit (20) also comprises said air-permeable wall (26).

8. A supply air device as defined in claim 7, characterized in that said convexly curved, air-permeable wall is constituted by a foamed plastic sheeting, said foamed plastic sheeting being secured centrally (at 28) adjacent to the perforated external element (21), on the one hand, and to each side guiding plate (24*a*,25*a*), at a distance inside the perforated external element, on the other hand.

9. A supply air device as defined in claim 8, characterized in that the foamed plastic sheeting is securable at the side guiding plates at a variable distance from the perforated external element for adjustment of the transversal side-spreading of the air flow.

10. A supply air device as defined in claim 6, characterized in that said detachable unit (20) is telescopically insertable into said box-like casing (10).

11. A supply air device as defined in claim 2, characterized in that said primary side-spreading means comprises a substantially tubular, air-permeable bag (18), e.g. of a filter material, such as polyester fibres, located inside said curved, air-permeable wall (26), said bag being connectable to said supply air duct (via 16,15) and having a decreasing cross-section along its length to permit a uniform air spreading circumferentially as well as longitudinally.

12. A supply air device as defined in claim 3, characterized in that a shield (30) is detachably arranged adjacent to at least one side element portion (22) so as to totally or partly cut off the transversal air flow from the respective side element portion.

13. A supply air device as defined in claim 12, characterized in that said shield consists of a plate strip (30), which is securable internally adjacent to the respective side element portion (22) and the width of which is less than or equal to the depth of the side element portion.

* * * * *